US012747865B2

(12) United States Patent
Hoffmann

(10) Patent No.: US 12,747,865 B2
(45) Date of Patent: Sep. 29, 2026

(54) COOKING HOB HAVING A COOKING SURFACE AND METHOD FOR CONFIGURATION AND/OR ADJUSTMENT OF A COOKING ZONE

(71) Applicant: ELECTROLUX APPLIANCES AKTIEBOLAG, Stockholm (SE)

(72) Inventor: Harald Hoffmann, Rothenburg ob der Tauber (DE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 1050 days.

(21) Appl. No.: 17/608,514

(22) PCT Filed: May 4, 2020

(86) PCT No.: PCT/EP2020/062245
§ 371 (c)(1),
(2) Date: Nov. 3, 2021

(87) PCT Pub. No.: WO2020/225177
PCT Pub. Date: Nov. 12, 2020

(65) Prior Publication Data

US 2022/0221155 A1 Jul. 14, 2022

(30) Foreign Application Priority Data

May 6, 2019 (EP) ..... 19172688

(51) Int. Cl.
*F24C 7/08* (2006.01)
*F24C 15/10* (2006.01)

(52) U.S. Cl.
CPC ..... *F24C 7/083* (2013.01); *F24C 15/106* (2013.01)

(58) Field of Classification Search
CPC ..... F24C 15/10; F24C 15/106; F24C 7/083
(Continued)

(56) References Cited

U.S. PATENT DOCUMENTS 1,961,976 A * 6/1934 Leonard ..... F24C 15/10 126/214 R
3,529,584 A * 9/1970 Trueba ..... F24C 3/124 126/39 N (Continued)

FOREIGN PATENT DOCUMENTS

DE 102005018276 10/2006
DE 202018104880 9/2018

OTHER PUBLICATIONS

International Search Report and Written Opinion for PCT/EP2020/062245, dated Aug. 5, 2020, 13 pages.

*Primary Examiner* — Steven W Crabb
*Assistant Examiner* — Keith Brian Assante
(74) *Attorney, Agent, or Firm* — Chrisman Gallo Tochtrop LLC

(57) ABSTRACT

The present invention relates to a cooking hob (1) having a cooking surface (5) with at least two cooking zones (3*a*, 3*b*, 3*c*, 3*d*) on which cookware (21) is placeable. Each cooking zone (3*a*,5 3*b*, 3*c*, 3*d*) is individually configurable and/or adjustable according to a selection mode. The selection mode comprises at least a selection and/or configuration of a power level for the cooking zone (3*a*, 3*b*, 3*c*, 3*d*). According to the invention, a code word and/or an identifier is allocatable to each cooking zone (3*a*, 3*b*, 3*c*, 3*d*) for controlling and/or addressing a spe-cific one of the cooking zones (3*a*, 3*b*, 3*c*, 3*d*). Further, a method for a configuration and/or adjustment of a cooking zone (3*a*, 3*b*, 3*c*, 3*d*) arranged on a cooking hob (1) which comprises at least two cooking zones (3*a*, 3*b*, 3*c*, 3*d*) is disclosed. The cooking zone (3*a*, 3*b*, 3*c*, 3*d*) is selected and/or addressed by identification of the cooking zone (3*a*, 3*b*, 3*c*, 3*d*) with an allocated code word or identifier.

20 Claims, 3 Drawing Sheets

Figure 1:
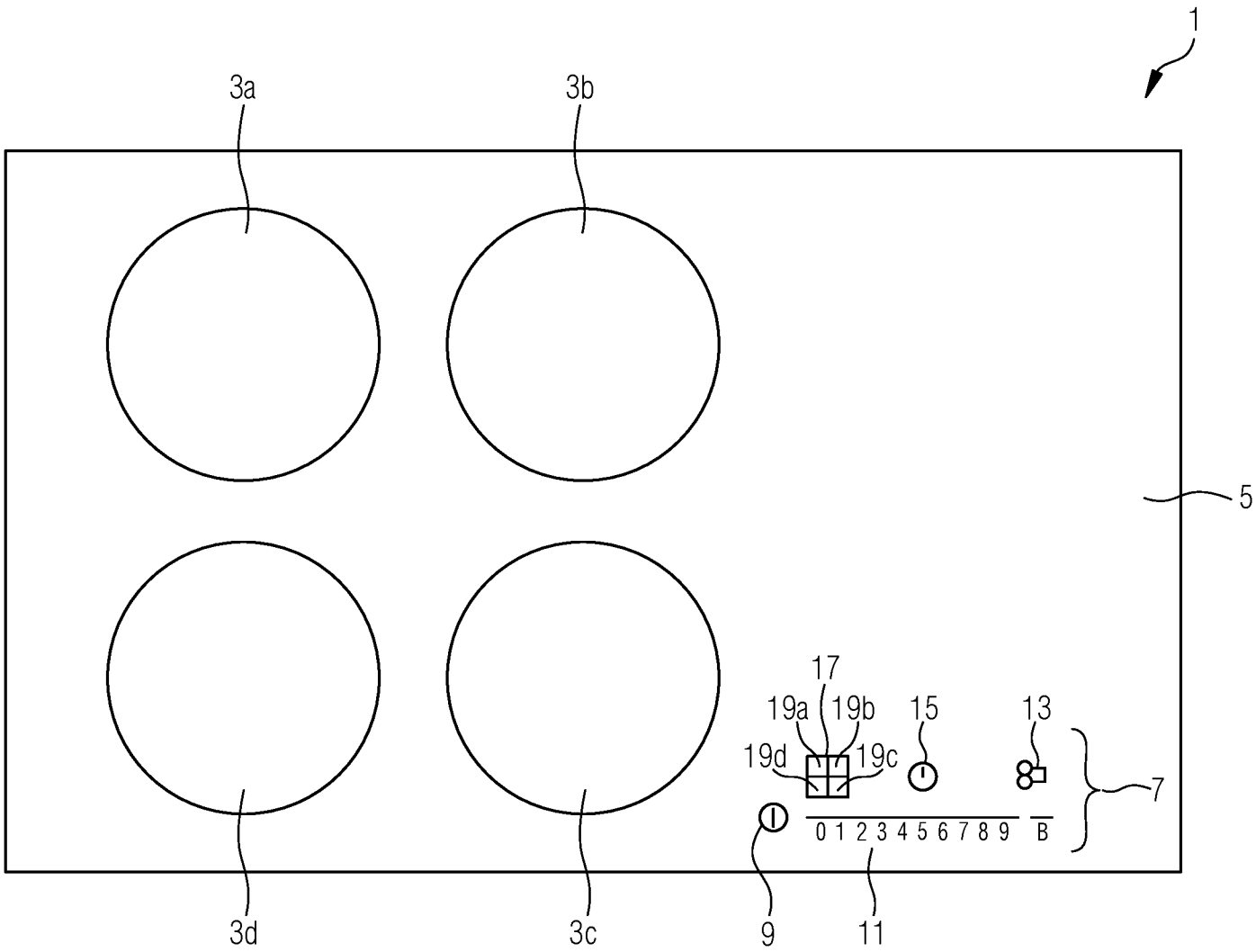

(58) Field of Classification Search
USPC ..... 219/506
See application file for complete search history.

(56) References Cited

U.S. PATENT DOCUMENTS

| | | | | |
|---|---|---|---|---|
| 8,875,691 | B1 * | 11/2014 | Saint Joy | F24C 7/082 126/39 BA |
| 10,139,852 | B2 * | 11/2018 | Crosby | F24C 3/124 |
| 2005/0057529 | A1 * | 3/2005 | Mairal Serrano | F24C 7/082 345/173 |
| 2007/0170168 | A1 * | 7/2007 | Moschetti | H05B 3/74 219/445.1 |
| 2011/0098831 | A1 * | 4/2011 | Diehl | F21V 23/04 700/90 |
| 2013/0270251 | A1 * | 10/2013 | Furuti | H05B 3/68 219/447.1 |
| 2016/0299595 | A1 * | 10/2016 | Bach | F24C 7/086 |
| 2017/0299195 | A1 * | 10/2017 | Bach | H05B 1/0202 |
| 2018/0314287 | A1 * | 11/2018 | Crosby | G05G 5/03 |

* cited by examiner

COOKING HOB HAVING A COOKING SURFACE AND METHOD FOR CONFIGURATION AND/OR ADJUSTMENT OF A COOKING ZONE

The present invention relates to a cooking hob having a cooking surface with at least two cooking zones. The present invention further relates to a method for configuration and/or adjustment of a cooking zone arranged on a cooking hob which comprises at least two cooking zones.

Cooking hobs, in particular cooking hobs for domestic use, with at least two cooking zones are commonly controlled by an individual configuration and/or adjustment according to a selection which at least enables setting of a power level for the respective cooking zone. Each cooking zone can be configured and/or adjusted by means of an allocated control means which may be a control knob or a touch sensitive input means or the like. In order to identify the control means for the respective cooking zone, markings or other optical allocation indicators are known.

Nowadays, more and more cooking hobs are configurable and/or adjustable by way of remote control means including voice control means and/or gesture control means. In particular when the user is distant from the cooking hob, a control of the cooking zone which shall be configured and/or adjusted is cumbersome, mainly in relation to the addressing of the specific cooking zone. This is even more cumbersome with cooking hobs without fixed cooking zones, also known as "cook anywhere" induction hobs.

It is an object of the present invention to provide a cooking hob of the introductorily described nature as well as a method for a configuration and/or adjustment of a cooking zone arranged on a cooking hob as initially described, which allow a simple addressing or selection of a specific cooking zone for its configuration and/or adjustment also from a remote position.

According to the present invention, a cooking hob comprises at least two cooking zones on which cookware is placeable. Each of the cooking zones is individually configurable and/or adjustable according to a selection mode. The selection mode comprises at least a selection and/or a configuration of a power level for the cooking zone. Another example for a parameter and/or a value is selectable within the framework of the selection mode may be a selection or configuration of a preset time for a cooking zone. According to the invention, a code word and/or an identifier is allocatable to each cooking zone. Such a code word and/or identifier enables a controlling and/or addressing or selection of a specific one of the cooking zones without circumstances. By providing a cooking zone with a specific code word and/or identifier, a simple control, in particular a simple addressing, of a cooking zone even from a remote position is provided.

Particularly, each cooking zone is configurable and/or adjustable by way of identifying and/or addressing the respective cooking zone using the allocated code word and/or identifier. With such a specific code word and/or identifier a cumbersome addressing of a cooking zone using its position like "cooking zone front left" is avoided. This is even more helpful when the exact position is not easily expressable, what may occur in case of the above-mentioned "cook anywhere" induction hobs.

In a specific embodiment at least one signalling device or display means, particularly a light source, e. g. an LED lamp, or an indicator light, is comprised. The signalling device or display means may be related to a cooking zone for providing information to a user of the cooking hob about the allocated code word and/or identifier for the related cooking zone. The information providing may be a visualization of the code word and/or the identifier to the user.

The signalling device or display means, in particular the light source or indicator light, may be arranged or arrangeable in such a way that the actual or the relative position of the related cooking zone is reflected and/or indicated.

Specifically, the signalling device or display means, in particular the light source or indicator light, is arranged or arrangeable on a display and/or control unit and the relative position of the cooking zone on the cooking surface is reproduced on the display and/or control unit. Alternatively, the signalling device or display means may be arranged or arrangeable next to or close to the cooking zone on the cooking surface.

A preferred embodiment is characterized by an identifier for at least one cooking zone which is a colour identifier. In that way, the cooking zone is identifiable or addressable by a colour, e. g. "yellow". With such colour identifier, the user may select the respective by just addressing this cooking zone with this simple word for this colour.

The cooking zone may be associated with a light source or indicator light, in particular an LED, which is illuminatable with a variable colour.

The selection and/or addressing of a cooking zone with the code word or the identifier may be even simpler in case of a cooking zone which further comprises a voice control means for the configuration and/or adjustment of the cooking zone or zones by means of vocal commands and/or vocal information transfer or input. The cooking zone in that case is configurable and/or adjustable by vocally addressing it by way of the allocated code word and/or identifier.

The cooking hob particularly further comprises a user interface with display and/or control elements which may be arranged for displaying a power level and/or a timer and/or input means. Such input means may be touch sensitive control elements. Preferably, a display and/or control element allocated to a cooking zone is illuminatable by a colour which is at least leaned on the colour identifier of the respective cooking zone.

The code word or identifier may be allocated or allocatable to at least two cooking zones for their joint configuration and/or adjustment. The individual cooking zones may at first be identifiable by different code words and/or identifiers and upon the user's choice, the at least two cooking zones may be combined and the joint code word and/or identifier may be selectable and allocatable.

A specifically preferred embodiment of the invention is a cooking hob which is an induction cooking hob and the code word or identifier is allocatable or allocated to a cooking zone by a control unit of the cooking hob after identification of the cooking zone by means of a pot detection unit. That means, a cooking zone is only defined at that moment when a cooking pot has been placed on the cooking surface and the pot detection unit of the induction hob has defined the location of placement as being the respective cooking zone. With the definition of the cooking zone a respective code word and/or identifier for the defined cooking zone is allocated or allocatable.

The code word and/or the identifier may be selected and/or allocated by a control unit of the cooking hob, in particular using predefined code words or identifiers from a storage unit of the cooking hob. Advantageously, however, the code word and/or identifier is selectable by the user of the cooking hob.

According to such method, a cooking zone is arranged on a cooking hob which comprises at least two cooking zones and the cooking zone is configurable and/or adjustable according to a selection mode. The selection mode provides at least a basis for a selection and/or configuration of a power level for the cooking zone. According to the invention, the cooking zone is selected and/or addressed by identification of the cooking zone with a code word or identifier allocated to the cooking zone.

Preferably, the cooking hob comprises input means for vocal commands and the cooking zone is configured and/or adjusted by a user providing vocal commands and/or vocal information transfer. The vocal command and/or vocal information transfer may comprise the code word and/or identifier for addressing the respective cooking zone. The vocal command and/or vocal information transfer particularly further comprises at least one control parameter and/or control value. The control parameter and/or control value may be a power level and/or a preset time for the cooking zone.

According to an embodiment, at least two cooking zones are combined with each other for a joint operation, in particular by a vocal command and/or vocal information transfer comprising the allocated code words and/or identifiers of the respective cooking zones. Preferably, a joint code word and/or a joint identifier is selected for addressing the combination of the combined cooking zones.

Novel and inventive features of the present invention are set forth in the appended claims.

Figure 2:
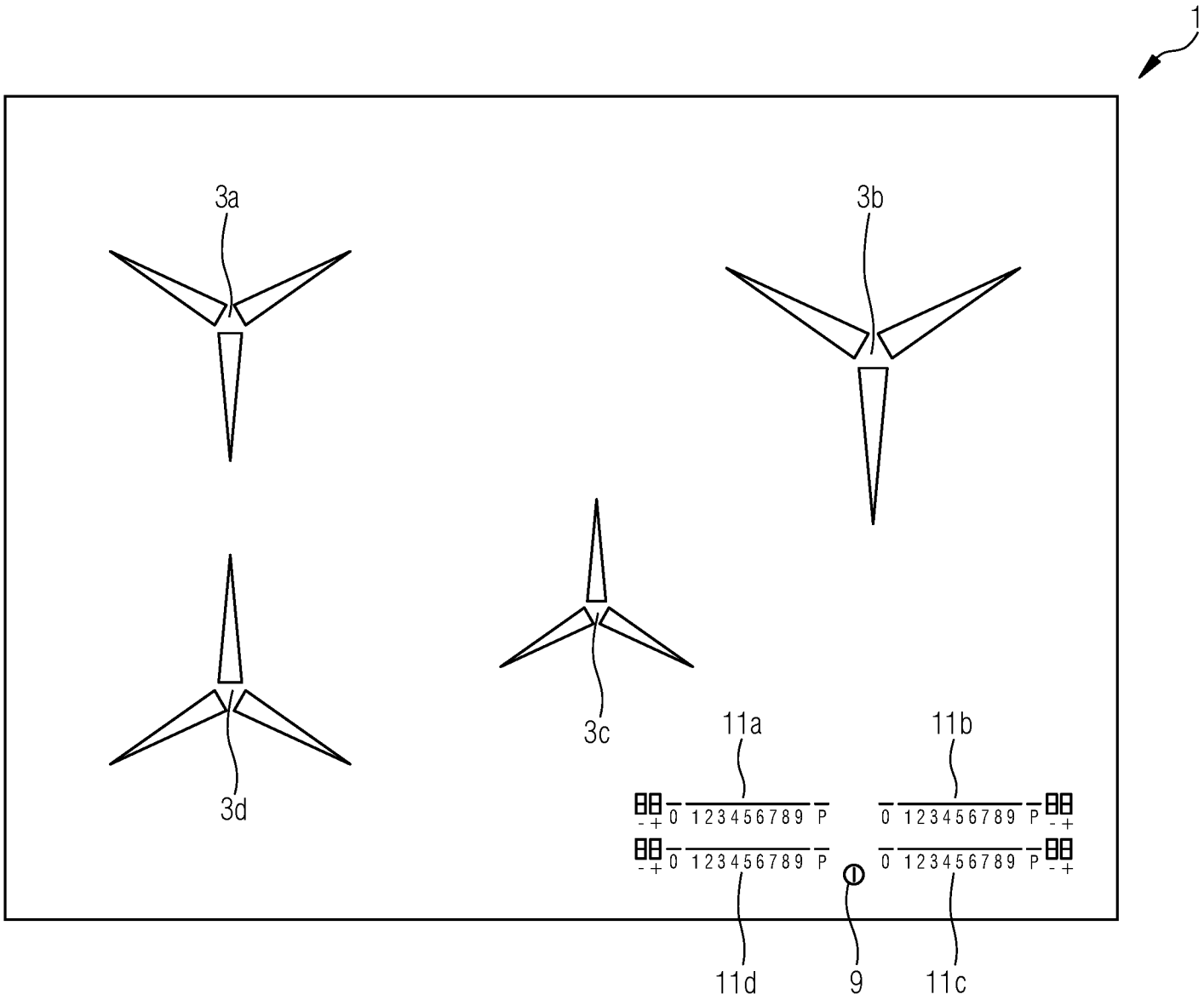
Figure 3:
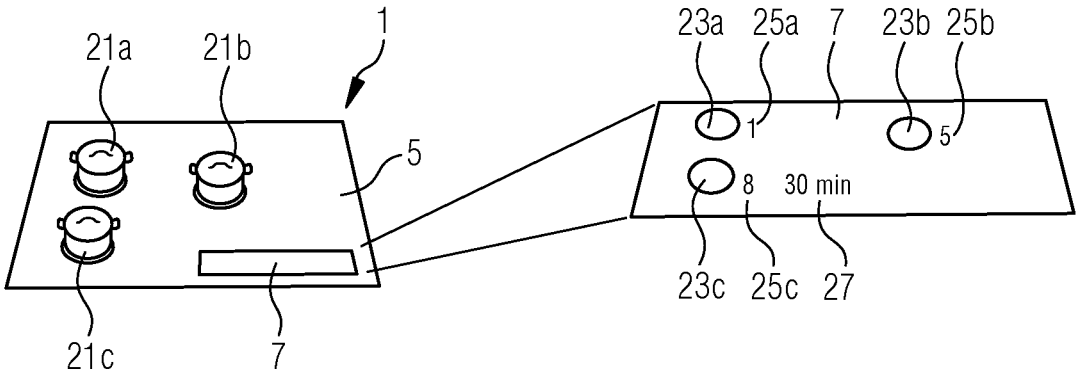

The present invention will be described in further detail with reference to the drawing, in which FIG. 1 illustrates a cooking hob according to a first embodiment of the invention;

FIG. 2 illustrates a cooking hob according to a second embodiment of the invention; and FIG. 3 illustrates a cooking hob according to a third embodiment of the invention.

FIG. 1 illustrates a top view on a cooking hob 1 comprising four fixedly arranged cooking zones 3*a*, 3*b*, 3*c*, 3*d* which are located on a glass plate 5 forming a cooking surface and supporting cookware 21 to be placed thereon. The cooking zones 3*a*, 3*b*, 3*c*, 3*d* are indicated on the glass plate 5 by circles imprinted on the glass plate 5 and may be heated by radiation heating elements (not shown) located beneath the glass plate 5. Alternatively, the cooking zones 3*a*, 3*b*, 3*c*, 3*d* may be induction cooking areas, wherein heating power is supplied by means of induction coils which also may be located beneath the glass plate 5, respectively.

The glass plate 5 further comprises a touch sensitive command input and display area 7 forming a user interface for the cooking hob 1. By means of said user interface, control commands, e.g. a power level setting, can be provided to a control unit (not shown) of the cooking hob 1, which control unit then controls the heating elements accordingly. The user interface comprises an ON/OFF switch 9, a touch slider 11 enabling a setting of power levels between 0 and 9 as well as a boost level B, a cooking zone connection switch 13, a timer symbol 15 for input of a preset time and a squarish selection array 17 for the selection of a specific one of the cooking zones 3*a*, 3*b*, 3*c*, 3*d*.

The selection array 17 is subdivided into four smaller squares 19*a*, 19*b*, 19*c*, 19*d*, each one representing and being allocated to is one of the four cooking zones 3*a*, 3*b*, 3*c*, 3*d*. The allocation of square 19*a*, 19*b*, 19*c*, 19*d* to respective cooking zone 3*a*, 3*b*, 3*c*, 3*d* is following the arrangement of the cooking zone 3*a*, 3*b*, 3*c*, 3*d* on the glass plate 5. In order to provide a setting to a specific cooking zone 3*a*, 3*b*, 3*c*, 3*d*, the respective square has to be touched by the user at first. After selecting the cooking zone 3*a*, 3*b*, 3*c*, 3*d* which shall be set that way, a selection of the desired power level is possible by touching the touch slider 11 at the position representing the desired power level. Due to the initial selection of the cooking zone 3*a*, 3*b*, 3*c*, 3*d* by means of the allocated square 19*a*, 19*b*, 19*c*, 19*d*, only one touch slider 11 is needed.

Besides the possibility to provide inputs to the cooking 1 hob via the command input and display area 7, the cooking hob 1 further comprises a voice control means (not shown) for performing the respective control commands or information transfer vocally. A vocal command usually comprises an identification of the cooking zone 3*a*, 3*b*, 3*c*, 3*d* which shall be set or adjusted, as well as the control parameter or control value, e. g. the power level. Such a vocal command may be "front left seven" which will cause the control unit of the cooking hob 1 to set or adjust the cooking zone 3*a*, 3*b*, 3*c*, 3*d* on the front left position to power level "7".

However, in order to make the selection and identification of the cooking zone 3*a*, 3*b*, 3*c*, 3*d* to be adjusted simpler, there is no need to identify and mention the position of this cooking zone 3*a*, 3*b*, 3*c*, 3*d*. Rather, specific identifiers are allocated to all four cooking zones 3*a*, 3*b*, 3*c*, 3*d*, which identifiers are characterized by a colour. That way, the cooking zone 3*a* is designated by "yellow", the cooking zone 3*b* is designated by "red", the cooking zone 3*c* is designated by "green" and the cooking zone 3*d* is designated by "blue". Respectively, the allocated is squares 19*a*, 19*b*, 19*c*, 19*d* on the command input and display area 7 are pigmented by yellow, red, green or blue colours, respectively. With such colour information on the command input and display area 7, the user is made aware of the identifier of the cooking zone 3*a*, 3*b*, 3*c*, 3*d* which shall be set or adjusted. Consequently, the above-mentioned vocal command "front left seven" is modified by "blue seven". In order to also visualize the selection of a cooking zone 3*a*, 3*b*, 3*c*, 3*d* by touch input, also the touch slider 11 is also illustrated in the respective colour after touching the allocated square 19*a*, 19*b*, 19*c*, 19*d*.

The cooking hob 1 according to FIG. 2 differs from the cooking hob 1 according to FIG. 1 in that the four cooking zones 3*a*, 3*b*, 3*c*, 3*d* are represented by three-spike symbols, whereas the length of the spikes representing the dimension of the cooking zone. Each three-spike symbol is illuminated in a specific colour indicating the allocated identifier, similarly to the identifier of the cooking zones 3*a*, 3*b*, 3*c*, 3*d* in FIG. 1. A further difference is the provision of four touch sliders 11*a*, 11*b*, 11*c*, 11*d*, so that each cooking zone 3*a*, 3*b*, 3*c*, 3*d* is allocated to a specific touch slider 11*a*, 11*b*, 11*c*, 11*d*. Although the colour indication is already realized by the above-described colour illumination of the spikes, also the touch sliders 11*a*, 11*b*, 11*c*, 11*d* are illuminated the same way.

FIG. 3 illustrates an induction cooking hob 1 without fixed cooking zones. Rather, the cookware 21 can be placed anywhere on the cooking surface, i. e. on the glass plate 5. The cookware positions are reproduced on a command input and display area 7 by pot position symbols 23*a*, 23*b*, 23*c*. Also in this example embodiment the cooking zones are capable of being differentiated by means of a colour identifier and the pot position symbols 23*a*, 23*b*, 23*c* are respectively illuminated in different colours. Accordingly, vocal control commands can be given in the same way as described above for the cooking hob 1 of FIG. 1. The command input and display area 7 further indicates the set power level by means of respective numerals 25*a*, 25*b*, 25*c* as well as a preset time value 27 for pot position 23 *c*.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

1 cooking hob
3*a*, 3*b*, 3*c*, 3*d* cooking zones
5 glass plate
7 command input and display area
9 ON/OFF switch
11, 11*a*, 11*b*,
11*c*, 11*d* touch slider
13 cooking zone connection switch
15 timer symbol
17 selection array
19*a*, 19*b*,
19*c*, 19*d* squares
21 cookware
23*a*, 23*b*, 23*c* pot position symbols
25*a*, 25*b*, 25*c* power level numerals
27 preset time value

The invention claimed is:

1. A cooking hob having a cooking surface with at least two cooking zones on which cookware is placeable, wherein the cooking hob is configured such that:

each said cooking zone is individually configurable and/or adjustable according to a selection mode, the selection mode comprising a selection and/or configuration of a power level for the respective cooking zone, and for each said cooking zone, a respective code word and/or identifier is selectable by the user of the cooking hob for controlling and/or addressing the cooking zone, wherein the cooking hob is configured to allocate the respective code word and/or identifier selected by the user to the cooking zone.

2. The cooking hob according to claim 1, wherein each said cooking zone is configurable and/or adjustable via identification by way of the allocated code word and/or identifier.

3. The cooking hob according to claim 1, further comprising a signalling device or display means related to a first of said cooking zones for providing information to a user of the cooking hob about the allocated code word and/or identifier for the first cooking zone.

4. The cooking hob of claim 3, wherein the signalling device or display means comprises a light source or indicator light and is arranged or arrangeable such that an actual or relative position of the first cooking zone is reflected and/or indicated.

5. The cooking hob of claim 3, wherein the signalling device or display means is arranged or arrangeable:

on a display and/or control unit, wherein the relative position of the first cooking zone on the cooking surface is reproduced on the display and/or control unit, or next to or close to the first cooking zone on the cooking surface.

6. The cooking hob according to claim 1, wherein the code word and/or identifier for at least one said cooking zone is a colour identifier.

7. The cooking hob according to claim 1, wherein a first said cooking zone is associated with a light source or indicator light which is illuminatable with a variable colour.

8. The cooking hob of claim 1, further comprising a voice control means for configuration and/or adjustment of the cooking zones by means of vocal commands and/or vocal information transfer, wherein each said cooking zone is configurable and/or adjustable by vocally addressing it by way of the allocated code word and/or identifier.

9. The cooking hob according to claim 1, further comprising a user interface having a display and/or control element allocated to a first of said cooking zones whose allocated code word and/or identifier is a colour identifier, wherein the display and/or control element is illuminatable by a colour which is at least leaned on the colour identifier of the first cooking zone.

10. The cooking hob of claim 1, wherein the code word and/or identifier allocated or allocatable to a first of said cooking zones is jointly allocated to both the first and a second one of said cooking zones when the first and second cooking zones are operated in joint configuration.

11. The cooking hob according to claim 1, wherein the cooking hob is an induction cooking hob and the code word and/or identifier is allocatable or allocated to a first of said cooking zones by a control unit of the cooking hob after identification of the first cooking zone by means of a pot detection unit.

12. A method of operating the cooking hob according to claim 1, wherein a first code word and/or identifier is allocated to each said cooking zone, wherein a first cooking zone of the at least two cooking zones is selected and/or addressed by identification of the first cooking zone with the first code word and/or identifier.

13. The method according to claim 12, wherein the first cooking zone is configured and/or adjusted by a user providing vocal commands and/or vocal information transfer, which vocal command and/or vocal information transfer comprises the first code word and/or identifier for addressing the first cooking zone and further comprises at least one control parameter and/or control value.

14. The method according to claim 13, wherein the at least one control parameter and/or control value is the power level and/or a preset time.

15. The method according to claim 13, wherein the at least two cooking zones are combined with each other for a joint operation by a vocal command and/or vocal information transfer comprising the respective code words and/or identifiers allocated to the respective cooking zones, wherein a joint code word and/or a joint identifier is selected for addressing the combination of the combined cooking zones.

16. A cooking appliance comprising:

the cooking hob according to claim 1; and a user interface comprising an array of selection elements associated respectively with the at least two cooking zones, each said selection element having a geographic position within the array corresponding to a geographic position of the associated cooking zone relative to the at least two cooking zones on the cooking surface; each said selection element being associated with a respective color different from the color(s) of the other cooking zone(s);

wherein the cooking appliance is configured to process a first voice command comprising a first code word and/or identifier and a first setting input, identify a first selected cooking zone of the at least two cooking zones with said first code word and/or identifier, and to apply the first setting input to the first selected cooking zone;

wherein the first code word and/or identifier comprises the color associated with the selection element associated with the selected cooking zone.

17. The cooking appliance of claim 16, being further configured to:

process a second voice command comprising a second code word and/or identifier and a second setting input, identify a second selected cooking zone of the at least two cooking zones with the second code word and/or identifier, and to apply the second setting input to the second selected cooking zone;

wherein said second setting input is a power-level setting for the second selected cooking zone.

18. The cooking appliance of claim 17, being further configured to combine said first selected cooking zone and said second selected cooking zone for joint operation by a vocal command and/or vocal information transfer comprising the first and second code words and/or identifiers, and to allocate jointly to the first and second selected cooking zones a joint code word and/or identifier while the first and second selected cooking zones are in joint operation in order to apply a joint setting input jointly to the first and second selected cooking zones.

19. The cooking hob of claim 1, wherein a respective code word is allocatable to each said cooking zone for controlling and/or addressing the cooking zone, the code word being selectable by the user of the cooking hob.

20. The cooking hob of claim 1, wherein a respective identifier is allocatable to each said cooking zone for controlling and/or addressing the cooking zone, the identifier being selectable by the user of the cooking hob.

* * * * *